US012716332B2

(12) United States Patent
Torrent et al.

(10) Patent No.: US 12,716,332 B2
(45) Date of Patent: Aug. 25, 2026

(54) ELECTROLYTIC PUMPING SYSTEM

(71) Applicants: Felix Antonio Torrent, Burkburnett, TX (US); Margarita Santa, Burkburnett, TX (US)

(72) Inventors: Felix Antonio Torrent, Burkburnett, TX (US); Margarita Santa, Burkburnett, TX (US)

( * ) Notice: Subject to any disclaimer, the term of this patent is extended or adjusted under 35 U.S.C. 154(b) by 0 days.

(21) Appl. No.: 18/969,440

(22) Filed: Dec. 5, 2024

(65) Prior Publication Data

US 2026/0160156 A1 Jun. 11, 2026

(51) Int. Cl.

| | |
|---|---|
| ***E21B 43/12*** | (2006.01) |
| ***E21B 33/03*** | (2006.01) |
| ***E21B 33/04*** | (2006.01) |
| ***E21B 34/04*** | (2006.01) |
| ***E21B 41/04*** | (2006.01) |
| ***E21B 41/06*** | (2006.01) |
| ***E21B 41/08*** | (2006.01) |
| ***E21B 41/10*** | (2006.01) |
| ***E21B 43/10*** | (2006.01) |
| ***F04B 39/12*** | (2006.01) |
| ***F04B 53/16*** | (2006.01) |
| ***F04F 99/00*** | (2009.01) |

(52) U.S. Cl.

CPC ..... *E21B 43/121* (2013.01); *F04F 99/00* (2013.01); *E21B 33/03* (2013.01); *E21B 33/04* (2013.01); *E21B 34/04* (2013.01); *E21B 41/04* (2013.01); *E21B 41/06* (2013.01); *E21B 41/08* (2013.01); *E21B 41/10* (2013.01); *E21B 43/103* (2013.01); *F04B 39/121* (2013.01); *F04B 53/16* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,417,823 | A | 12/1968 | Faris | |
| 5,252,192 | A | 10/1993 | Ludwig | |
| 2012/0222953 | A1 | 9/2012 | Anderson | |
| 2012/0318520 | A1* | 12/2012 | Lugo | E21B 21/001 166/363 |
| 2013/0118752 | A1* | 5/2013 | Hannegan | E21B 47/001 166/336 |
| 2015/0060139 | A1* | 3/2015 | Brice | E21B 4/14 175/19 |
| 2016/0160113 | A1* | 6/2016 | Nguyen | C09K 8/57 175/65 |
| 2016/0376488 | A1* | 12/2016 | Galindo | C09K 8/035 175/65 |

(Continued)

OTHER PUBLICATIONS

Search Report and Written Opinion for International Application No. PCT/US25/56038, dated Feb. 19, 2026, 12 pages.

*Primary Examiner* — Binh Q Tran
(74) *Attorney, Agent, or Firm* — Lee & Hayes, P.C.

(57) ABSTRACT

An electrolytic pumping system for use in drilling including horizontal and deviated wellbores. The electrolytic pumping system may be configured with one or more chambers to cause oxidation, reduction, and/or redox reactions with liquid in a reservoir. For example, each chamber may include one or more anode and/or cathode to introduce positive and/or negative charges into the liquids and cause the formation of gas and a positive pressure proximate to the liquid being extracted.

20 Claims, 5 Drawing Sheets

(56) References Cited

U.S. PATENT DOCUMENTS

| | | | | |
|---|---|---|---|---|
| 2018/0230787 | A1 | 8/2018 | Stokholm et al. | |
| 2019/0169969 | A1 | 6/2019 | Al-Mulhem et al. | |
| 2020/0340339 | A1* | 10/2020 | Saltykov | E21B 43/24 |
| 2022/0333464 | A1* | 10/2022 | Perri | C23F 13/06 |
| 2022/0341305 | A1* | 10/2022 | Bayyouk | F04B 53/162 |

* cited by examiner

ELECTROLYTIC PUMPING SYSTEM

BACKGROUND

When extracting liquids or gases from a position beneath the surface of the Earth, typically a well is drilled connecting the surface with a reservoir located below the surface. Often, when the reservoir pressure is low, an artificial lifting technique may be applied via a pump to cause the liquids or gases from the reservoir to rise to the surface. A variety of pumps exist for pumping the liquids or gases from a lower position to a high position. These conventional pumps often rely on a mechanical motor, such as a diesel motor or electric motor, positioned in the top of the wellhead or in the bottom of the well. However, these conventional pumps often exhibit failures, blockages, and cogs when used in conjunction with a horizontal or deviated well shaft.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Figure 1:
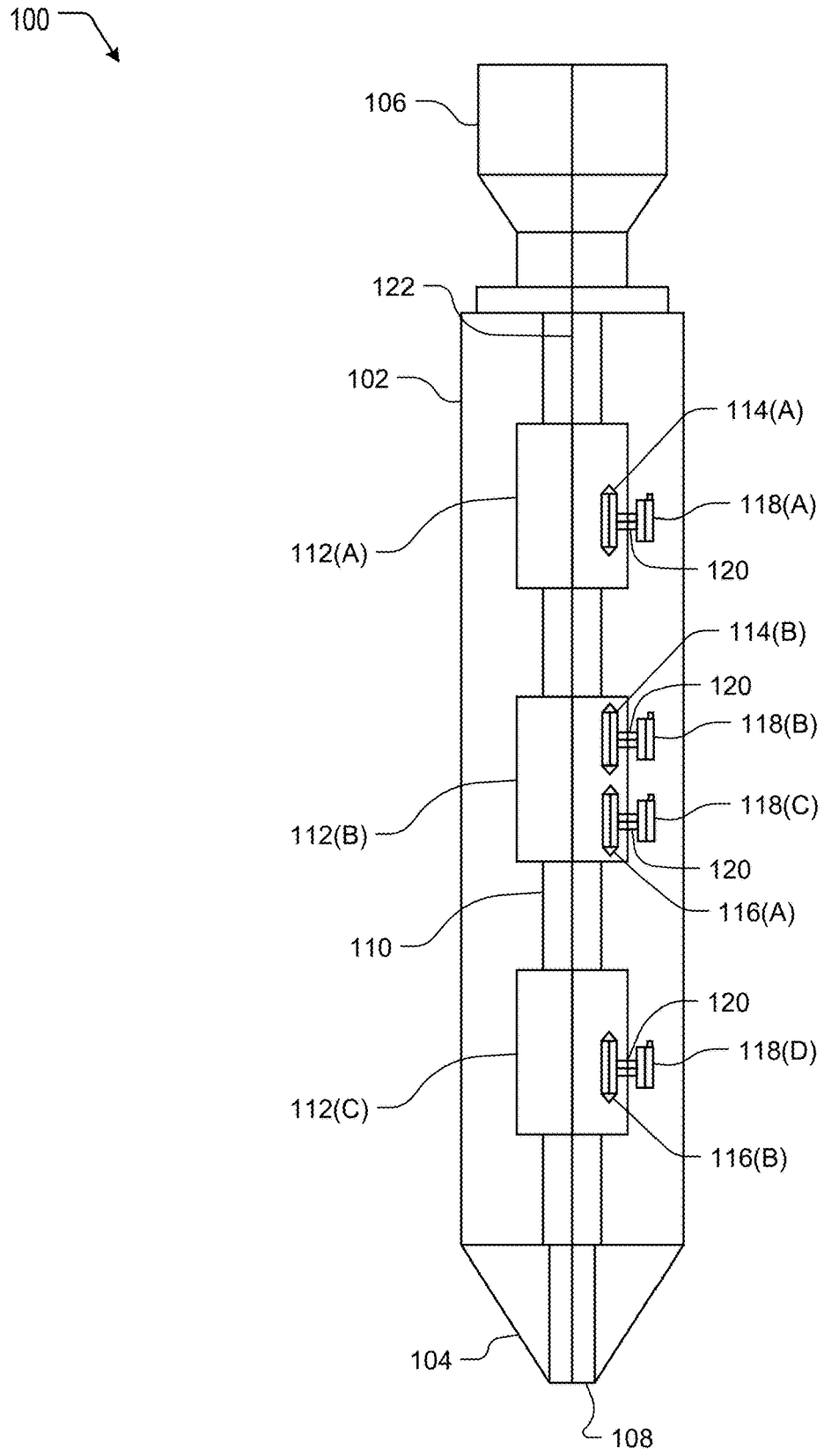
FIG. 1 illustrates an example of electrolytic pumping system according to some implementation.

The present disclosure is directed to an electrolytic pump for extracting liquids and/or gases from reservoirs below the surface of the Earth or otherwise moving (e.g., pumping) liquids and/or gases from a lower position to a high position. For example, in drilling installations (such as those used for oil and/or gas extraction) when the reservoir pressure is low, an artificial lifting technique may be applied via a pump to cause the liquids or gases from the reservoir to rise to the surface. A variety of pumps exist for pumping the liquids or gases from a lower position to a high position. These conventional pumps often rely on mechanical motors, such as a diesel motor or electric motor, positioned in the top of the wellhead or in the bottom of the well. However, recently the drilling industry has seen widespread adoption of drilling methods using horizontal or deviated well shafts.

The use of horizontal or deviated well shafts allow for the improved production or extraction of the liquids and/or gases from the reservoirs. The horizontal or deviated wells allow for larger contact areas per well (e.g., exposing larger areas of the reservoir to the wellbore), improved drainage of the reservoir, enhanced recovery (e.g., opening of shale oil and gas reservoirs for extraction, improved sweep efficiency, and the like), enhanced environmental impact (e.g., reduction in surface footprint and wells, lower water usage, and the like) as well as reduction in costs (e.g., fewer wells are drilled thus reducing equipment costs and drilling costs), and the like.

Unfortunately, conventional pumps (e.g., often relying on diesel motors or electric motors positioned on the wellhead pr in the bottom of the well.) often experience unique challenges when combined with horizontal or deviated well shafts. For example, the complex geometry of the horizontal or deviated well shafts can introduce complex geometries and fluid flows or patterns that cause liquid loading, gas locking, and slugging. The horizontal or deviated well shafts may also increase backpressure along the wellbore and cause increased wear and tear on the pumps (often resulting in an increase in down time for the well).

The electrolytic pumping system discussed herein may be configured to operate with respect to wells configured with either traditional (e.g., substantially vertical) and horizontal or deviated well shafts. The electrolytic pumping system may be configured to be inserted at the bottom or end of the well shaft in proximate to or submerged within the liquid or gas of the reservoir. The electrolytic pumping system may be configured to cause the liquids and/or gases to undergo electrolysis within the reservoir below the surface of the Earth.

In some examples, the electrolytic pumping system may have a substantially cylindrical shape with a point or cone positioned along the base or head (e.g., the portion that may be inserted first into the wellbore). In some cases, the cylindrical shape may be hexagonal, octagonal, decagonal, dodecagonal, or the like. In various implementations, the overall conical design of the electrolytic pumping system may enable easier insertion and/or removal of the pump to and from the bottom of the wellbore including in wellbores that have horizontal or deviated well shafts.

In some examples, the electrolytic pumping system may include a discharge head at the top of the pump (e.g., the end opposition the base). In some cases, the discharge head may be releasably coupled to one or more tubing sections that may couple the electrolytic pumping system in fluid communication with a subsequent discharge head or wellhead and/or a storage container located at the surface. In some cases, the discharge head at the rear of the electrolytic pumping system may be in fluid communication with the fluids or gases of the reservoir via an opening along the conical base of the electrolytic pumping system. For instance, as the electrolytic pumping system is submerged into the liquid or gases of the reservoir at least a portion of the liquid or gases may enter the interior chamber of the electrolytic pumping system.

In some cases, at least an exterior of the conical base, the discharge head, a body of the electrolytic pumping system may be formed from various steel alloys or other materials configured for high pressure and high temperature applications.

The electrolytic pumping system may also include one or more chambers positioned along the interior and in fluid communication between the opening of the conical base and the discharge head of the pump. In some examples, the electrolytic pumping system may be configured to cause an increase in temperature within the chamber forming gases or gasifying the liquid of the reservoir as the liquid enters the chamber via the opening in the conical base. For example, the chambers may include induction elements, microwave generation elements, radioactivity generation elements, ultrasound devices, and/or the like. In these examples, the induction elements, microwave generation elements, radioactivity generation elements, ultrasound devices, and/or the like may cause the liquids to heat to a desired temperature (such as a boiling point of the corresponding liquid) and to form one or more types of gas that generate a positive pressure within the chamber that raises the liquid towards the discharge head and ultimately towards the wellhead without cutting off the electrical supply to the pump.

In other examples, the electrolytic pumping system may be configured to negatively or positively charge molecules forming gases or releasing the gases into the liquid of the reservoir as the liquid enters the chamber via the opening in the conical base. As discussed herein, the formation of the gases within the liquid causes a positive pressure that raises the liquid towards the discharge head and ultimately towards the wellhead without cutting off the electrical supply to the pump. As the liquid and gases rise towards the surface, a vacuum is created within the chambers of the electrolytic pumping system that causes the liquid to be replaced by additional liquid within the reservoir (e.g., via pressure differential causing the liquid to flow from the higher pressure reservoir to the lower pressure created in the chamber in a vacuum process). Accordingly, in this example, as the additional liquid enters the chambers, the electrolytic pumping system charges the additional liquid causing the formation of additional gas which in turn raises the additional liquid toward the surface and so on and so forth.

In the current example, each of the chambers may be equipped with one or more anodes to introduce positive charges to the liquids and/or one or more cathodes to introduce negative charges to the liquids. For example, the anodes within the chamber may be configured to produce positive electrodes which may cause an oxidation of the liquids. For example, oxidation may occur from the loss of an electron associated with the liquid molecules as the electrons are attached to the positive ions produced by the anodes. As one example, an oxidation reaction of water may produce oxygen gases which cause the remaining liquids to rise.

Likewise, the cathodes within the chamber may be configured to produce negative electrodes which may cause a reduction reaction with respect to the liquids. For example, reduction reaction forming a new substance may occur from an introduction or gain of an electron associated with the liquid molecules as the electrons are attached to the positive ions produced by the anodes. The new substance is often a gas. For example, during electrolysis of water the hydrogen molecules gain electrons forming hydrogen gas.

In various examples, the chambers of the electrolytic pumping system may include both anodes and cathodes that may or may not be aligned, paired or otherwise positioned with respect to each other within the chamber. In some cases, the anodes and cathodes may work in combination to produce gases via a redox reaction (including both oxidation and reduction within the same chamber). In some instances, the chambers may be equipped with both anodes and/or cathodes as well as elements to raise the temperature of the liquids (e.g., the induction elements, the microwave generation elements, the radioactivity generation elements, the ultrasound devices, and/or the like). In some implementation, the electrolytic pumping system may include one or more chambers configured to negatively or positively charge molecules of the liquid as well as one or more chambers to increase the temperature of the liquid, such as a system to cause gases to form in the liquids in multiple manners, thereby increasing the reliability and adaptability of the electrolytic pumping system.

In various examples, the chambers and, accordingly, the anodes and cathodes, or other elements (e.g., the induction elements, the microwave generation elements, the radioactivity generation elements, the ultrasound devices, and/or the like) may be coupled to an electrical source to provide power and/or electricity for generating the positive and negative charges within the chamber. The electrical couplings may be positioned within a cable connector enclosure within the electrolytic pumping system that is proximate to each of the reaction chambers and in electrical communication with the anodes and cathodes. In some cases, the electrical coupling to the anodes and cathodes may be produced via an insulation or insulated sleeve. In this manner, the electrical cables and components may be isolated from the liquids within the chamber. In various examples, the cable connector enclosure and enclosure circuitry and components may be in electrical communication with a power source at the surface, such as via cabling within the tubing sections and/or via a separate cable external to the tubing section (such as via an exterior enclosure mounted along an exterior of the tubing).

In various examples, the electrolytic pumping system may be between approximately 4.0 meters (approximately 13 feet) and approximately 55 meters (approximately 180 feet) long or tall from the conical base to the discharge head. In other examples, the electrolytic pumping system may be between approximately 3 meters (approximately 10 feet) and approximately 4 meters (approximately 13 feet) long or tall from the conical base to the discharge head. In some examples, the circumference of the electrolytic pumping system may be approximately 60 millimeters (approximately 2 and ⅜ inches) and approximately 1,000 millimeters (approximately 40 inches). In another example the circumference of the electrolytic pumping system may be approximately 215 millimeters (approximately 8.5 inches) and approximately 355 millimeters (approximately 14 inches). In other cases, the electrolytic pumping system may be configured for the depth and circumference of the planned wellbore.

FIG. 1 illustrates an example of electrolytic pumping system 100 according to some implementation. In the current example, the electrolytic pumping system 100 is illustrated in a vertical configuration such as when deployed within a vertical wellbore. However, it should be understood that the electrolytic pumping system 100 may be utilized within horizontal and/or deviated wellbores as well.

As illustrated, the electrolytic pumping system 100 includes a body 102 forming an exterior of the electrolytic pumping system 100. The body may be formed of various steel alloys or other materials configured for high pressure and high temperature applications. As discussed above, the electrolytic pumping system 100 may be configured to be inserted at the bottom or end of the wellbore proximate to or submerged within the liquid or gas of the reservoir. Accordingly, the body 102 of the electrolytic pumping system 100 may be formed from a material that can withstand high pressure and high heat or temperatures often present below the surface of the Earth.

In some examples, the body 102 of the electrolytic pumping system 100 may have a substantially cylindrical shape with a point or cone positioned along the base or head (e.g., the portion that may be inserted first into the wellbore), generally indicated herein as conical base 104. In some cases, the cylindrical shape of the body 102 and base 104 may be hexagonal, octagonal, decagonal, dodecagonal, or the like. In various implementing, the overall conical design of the electrolytic pumping system 100 may enable easier insertion and/or removal of the pump 100 to and from the bottom of the wellbore including in wellbores that have horizontal or deviated well shafts.

In some examples, the body 102 and the electrolytic pumping system 100 may include a discharge head 106 at the rear (e.g., the end opposition the base). In some cases, the discharge head 106 may be releasably coupled to one or more tubing sections (not shown) that may couple the electrolytic pumping system 100 in fluid communication with a subsequent discharge head or wellhead and/or a storage container located at the surface. In some cases, the discharge head 106 may be in fluid communication with the liquids of the reservoir via an opening 108 along the conical base 104 of the electrolytic pumping system 100, as shown. For instance, as the electrolytic pumping system 100 is submerged into the liquid of the reservoir at least a portion of the liquid may enter an interior chamber 110 of the electrolytic pumping system 100.

In this example, the electrolytic pumping system 100 may be configured to cause the liquids within the reservoir to undergo electrolysis within the chamber below the surface of the Earth. Accordingly, the electrolytic pumping system 100 may also include one or more chambers, such as chambers 112(A), 112(B), and 112(C), positioned along the interior body 110 and in fluid communication between the opening 108 of the conical base 104 and the discharge head 106 of the electrolytic pumping system 100.

During operations, the electrolytic pumping system 100 may be configured to negatively, positively, or variable charge molecules forming or releasing gases into the liquid of the reservoir as the liquid enters each chamber 112 via the opening 108 in the conical base 104 and the interior shaft 110. In some implementations, each of the chambers 112 may be equipped with one or more anodes, such as anodes 114(A) and 114(B), to introduce positive charges to the liquids and/or one or more cathodes, such as cathodes 116(A) and 116(B), to introduce negative charges to the liquids. For example, the anodes 114 within the chambers 112 may be configured to produce positive electrodes which may cause an oxidation of the liquids and in some cases the body of the chamber (112) can act as an anode or cathode. For example, oxidation may occur from the loss of an electron associated with the liquid molecules as the electrons are attached to the positive ions produced by the anodes 114. As one example, an oxidation reaction of water may produce oxygen gases which cause the remaining liquids to rise.

Likewise, the cathodes 116 within the chambers 112 may be configured to produce negative electrodes which may cause a reduction reaction with respect to the liquids. For example, a reduction reaction forming a new substance may occur from an introduction or gain of an electron associated with the liquid molecules as the electrons are attached to the positive ions produced by the anodes 114. The new substance is often a gas. For example, during electrolysis of water the hydrogen molecules gain electrons forming hydrogen gas.

In various examples, the chambers 112 of the electrolytic pumping system 100 may include both anodes sand cathodes, such as anode 114(B) and the cathode 116(A). In various examples, the anodes 114 and cathodes 116 may or may not be aligned, paired or otherwise positioned with respect to each other within the chamber. In some cases, the anodes and cathodes may work in combination to produce gases via a redox reaction (including both oxidation and reduction within the same chamber).

The formation of the gases within the liquid by the oxidation and reduction reactions causes a positive pressure that raises the liquid towards the discharge head 106 and ultimately towards the wellhead without cutting off the electrical supply to the electrolytic pumping system 100. As the liquid and gases rise towards the surface, a vacuum is created within the chambers 112 of the electrolytic pumping system 100 that causes the liquid moving towards to surface to be replaced by additional liquid within the reservoir (e.g., via pressure differential causing the liquid to flow from the higher pressure reservoir to the lower pressure created in the chambers 112 in a vacuum process). Accordingly, as the additional liquid enters the chambers 112, the electrolytic pumping system 100 charges the additional liquid causing the formation of additional gas which in turn raises the additional liquid toward the surface and so on and so forth.

In various examples, the chambers 112 and, accordingly, the anodes 114 and cathodes 116 may be coupled to an electrical source to provide power and/or electricity for generating the positive and negative charges within each chamber 112. The electrical couplings may be positioned within a cable connector enclosure 118(A)-(D) within the electrolytic pumping system 100. In the current example, each of the anodes 114 and cathodes 116 have a corresponding cable connector enclosure 118(A)-(D). However, in other cases, such as cable connector enclosure 118(B) and 118(C) may be combined such that each chamber 112 has a single corresponding cable connector enclosure 118 and associated circuitry.

In some cases, the electrical coupling to the anodes 114 and cathodes 116 may be produced via an insulation or insulated sleeve or conduit 120. In this manner, the electrical cables and components may be isolated from the liquids within the chambers 112. In various examples, the cable connector enclosures 118 and enclosure circuitry and components may be in electrical communication with a power source at the surface, such as via cabling within the tubing sections and/or via a separate cable external to the tubing section (such as via an exterior enclosure mounted along an exterior of the tubing).

In the current example, the electrolytic pumping system 100 may also include one or more check valves, such as check valve 122 positioned along the interior shaft 110 between the discharge head 106 and the chambers 112 to prevent any liquid from returning or backflowing into the electrolytic pumping system 100, the chambers 112, and/or out of the opening 108 and ultimately back to the reservoir.

Figure 2:
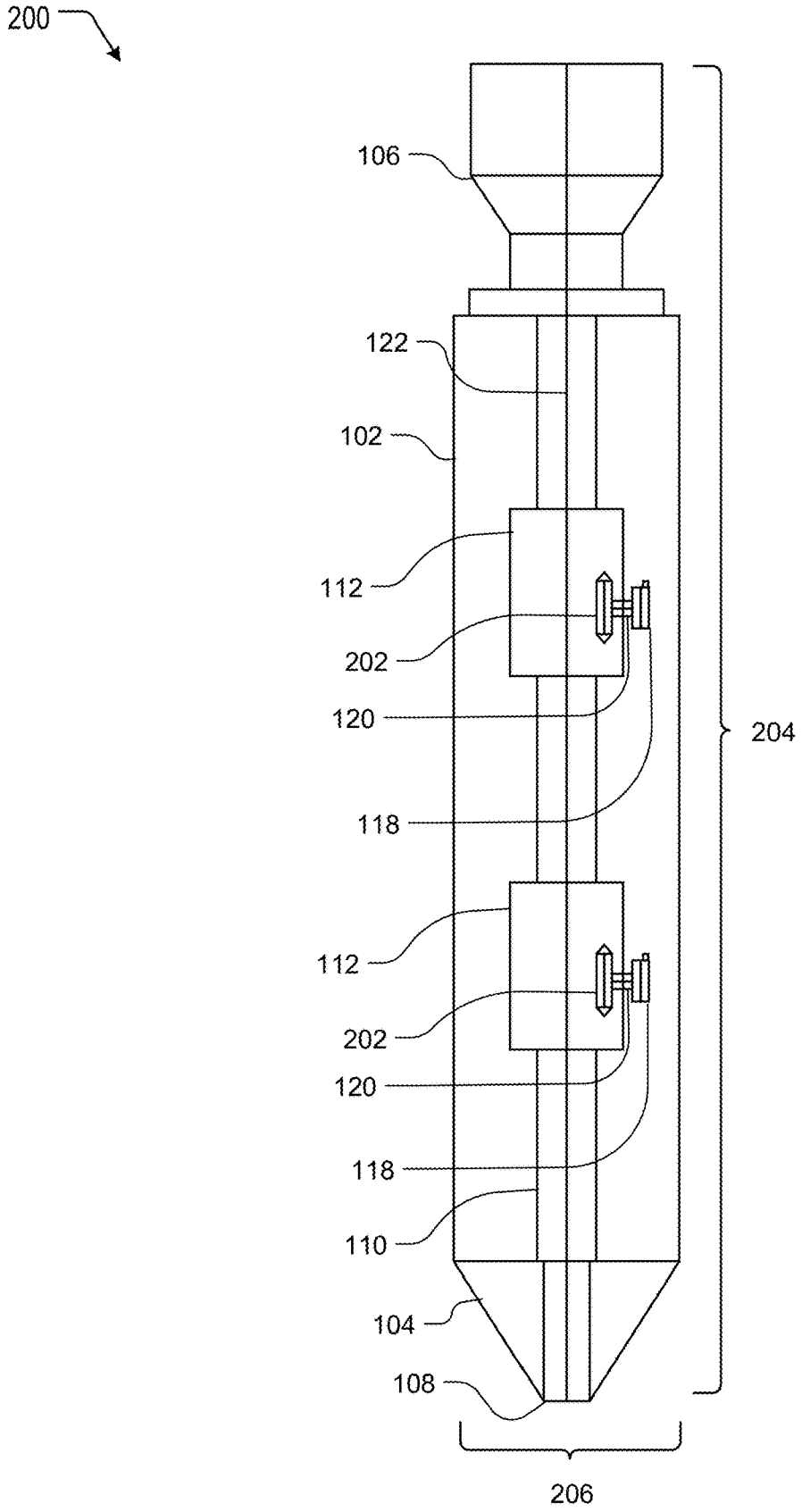
FIG. 2 illustrates another example of electrolytic pumping system according to some implementation.

FIG. 2 illustrates another example of electrolytic pumping system 200 according to some implementation. As discussed above, the electrolytic pumping system 200 may include a body 102, a conical base 104 having an opening 108, and a discharge head 106. The opening 108 may be in fluid communication with the discharge head 106 via an interior body 110. A number of chambers 112 may be positioned along the interior body 110 and in fluid communication with the liquid of the reservoir when the electrolytic pumping system 200 is deployed to a bottom of a well or submerged within the reservoir.

In various examples, the electrolytic pumping system 200 may include one or more chambers 112 that include a reaction element 202, such as either of the anodes and cathodes discussed above with respect to FIG. 1. In some cases, the reaction element 202 may include one or more anodes, one or more cathodes, as well as one or more induction elements, one or more microwave generation elements (e.g., a magnetron, solid-state power amplifiers (SSPAs), or the like), one or more radioactivity generation elements (e.g., particle accelerators, neutron generators, x-ray generators, and the like), one or more ultrasound devices, a combination of one or more thereof, or the like. As discussed herein, the reaction elements 202 may be electrically coupled to various components housed within a cable connector enclosure 118 via one or more insulated sleeve or conduit 120. The chambers 112 housing the reaction elements 202 cause the formation of the gases within the liquid of the reservoir via oxidation reactions, reduction reactions, redox reactions, and/or temperature increase within the liquid. As discussed above, the formation of the gases causes a positive pressure that raises the liquid towards the discharge head 106 and ultimately towards the wellhead without cutting off the electrical supply to the electrolytic pumping system 200. As the liquid and gases rise towards the surface, a vacuum is created within the chambers 112 of the electrolytic pumping system 200 that causes the liquid moving towards to surface to be replaced by additional liquid within the reservoir.

In various examples, the electrolytic pumping system 200 may have a length 204 that may be between approximately 6.0 meters (approximately 20 feet) and approximately 10 meters (approximately 32 feet) from the conical base 104 to the discharge head 106. In other examples, the length 204 of the electrolytic pumping system 200 may be between approximately 3.0 meters (approximately 10 feet) and approximately 4.0 meters (approximately 13 feet) from the conical base 104 to the discharge head 106.

The electrolytic pumping system 200 may have a circumference 206. In some examples, the circumference 206 of the electrolytic pumping system 200 may be approximately 60 millimeters (approximately 2 and ⅜ inches) and approximately 1,000 millimeters (approximately 40 inches). In another example, the circumference 206 of the electrolytic pumping system 200 may be approximately 215 millimeters (approximately 8.5 inches) and approximately 355 millimeters (approximately 14 inches). In other cases, the circumference 206 of the electrolytic pumping system 200 may be configured for the depth and circumference of the planned wellbore.

Figure 3:
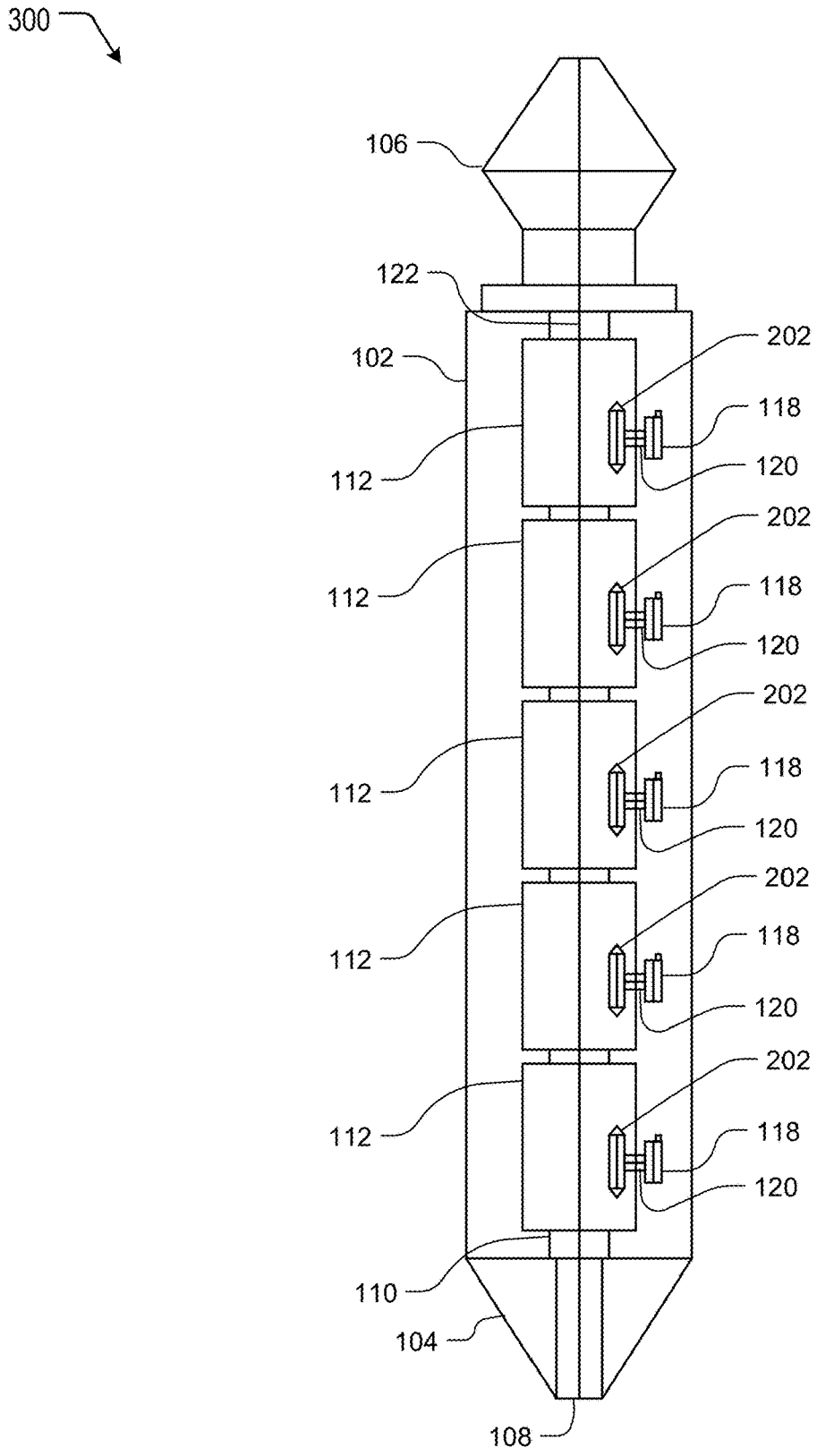
FIG. 3 illustrates an example of electrolytic pumping system according to some implementation.

FIG. 3 illustrates an example of an electrolytic pumping system 300 according to some implementations. As discussed above, the electrolytic pumping system 300 may include a body 102, a conical base 104 having an opening 108, and a discharge head 106. The opening 108 may be in fluid communication with the discharge head 106 via an interior body 110. A number of chambers 112 (in the current example five cambers to 100 chambers 112) may be positioned along the interior body 110 and in fluid communication with the liquid of the reservoir when the electrolytic pumping system 300 is deployed to a bottom of a well or submerged within the reservoir.

In various examples, the electrolytic pumping system 300 may include one or more chambers 112 that include both anodes and cathodes, generally indicated by 202. As discussed herein, the reaction elements 202 may be electrically coupled to various components housed within a cable connector enclosure 118 via one or more insulated sleeve or conduit 120. The chambers 112 housing the reaction elements 202 cause the formation of the gases within the liquid of the reservoir via corresponding oxidation and reduction reactions. As discussed above, the formation of the gases causes a positive pressure that raises the liquid towards the discharge head 106 and ultimately towards the wellhead without cutting off the electrical supply to the electrolytic pumping system 300. As the liquid and gases rise towards the surface, a vacuum is created within the chambers 112 of the electrolytic pumping system 200 that causes the liquid moving towards to surface to be replaced by additional liquid within the reservoir.

In the examples of FIGS. 1-3 various numbers of chambers are illustrated. It should be understood that the electrolytic pumping system, discussed herein, may have any number of chambers, anodes, cathodes, and/or any combination of anodes and/or cathodes within each chamber. In some cases, the dimensions of each chamber within the electrolytic pumping system may vary in size, length, width, shape, and the like with respect to each other, such that each chamber may differ from the others. Likewise, the number and arrangement of the anodes and cathodes within each chamber may vary with respect to each other to provide for different reactions within each chamber. In some cases, the number of chambers, size and dimension of the chambers as well as the arrangement, pairings, and/or number of anodes and cathodes may vary or be selected based on the liquid being extracted, dimension and direction of the wellbore and/or the like.

Figure 4:
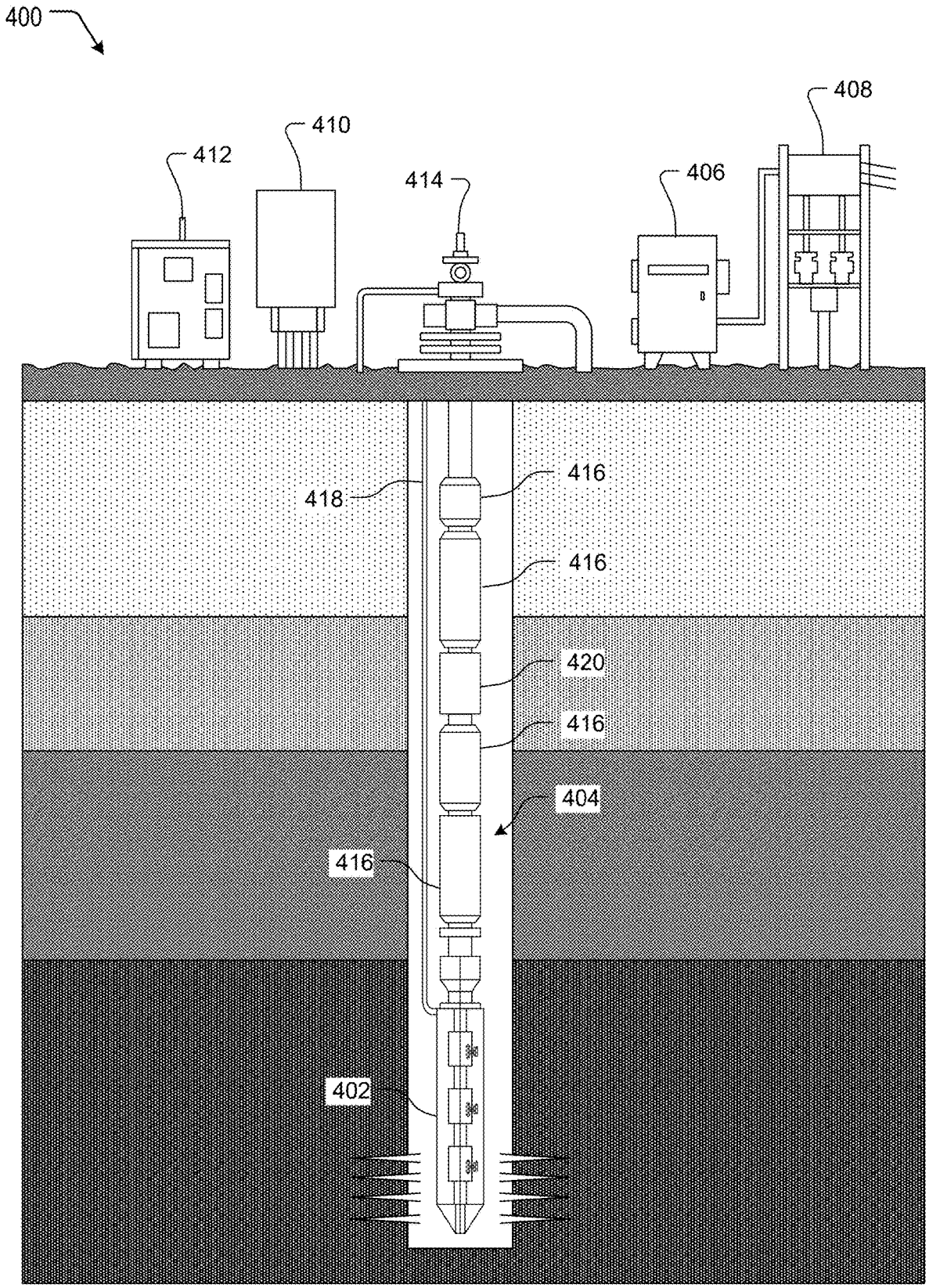
FIG. 4 illustrates an example drilling installation utilizing the electrolytic pumping system of FIGS. 1-3 according to some implementation.

FIG. 4 illustrates an example drilling installation 400 utilizing the electrolytic pumping system 402 of FIGS. 1-3 according to some implementation. In the current example, the drilling installation 400 may include a wellhead 414 located at the surface of the wellbore 404. The drilling installation 400 may also include a control system 406, a power supply 408, a storage container 410, as well as other components, generally indicated by 412, (such as a transformer or the like).

In the current example, the wellhead 414 is coupled to the electrolytic pumping system 402 via a number of tubing segments, generally indicated by 416. The electrolytic pumping system 402 may also be electrically coupled to the power source 408 via one or more cables 418. Using the power to generate positive or negative charges the electrolytic pumping system 402 may cause oxidation, reduction, and/or redox reactions associated with the liquids to cause a formation of gas and thereby a positive pressure that raises the liquid up the tubing 416 towards the wellhead 414. As the liquid and gases rise towards the surface, a vacuum is created within the electrolytic pumping system 402 that causes the liquid moving towards to surface to be replaced by additional liquid within the reservoir.

As the liquids reach the surface, the liquids may be stored in the storage container 410 until further transport is arranged. In the current example, a gas separator 420 is configured along the tubing 416 to remove or filter the gas from the liquid prior to storage in the container 410.

Figure 5:
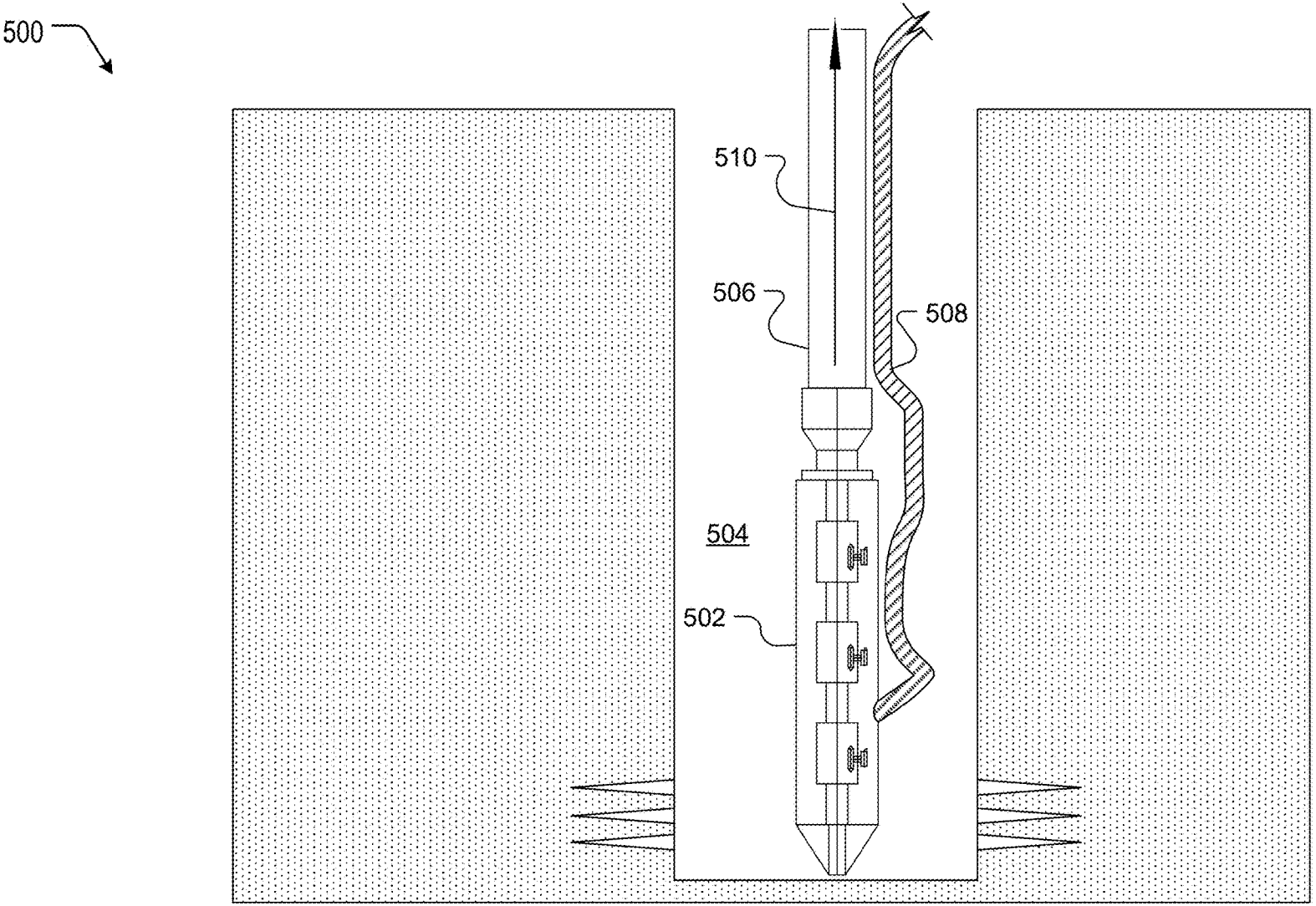
FIG. 5 illustrates another example drilling installation utilizing the electrolytic pumping system of FIGS. 1-3 according to some implementation.

FIG. 5 illustrates another example drilling installation 500 utilizing the electrolytic pumping system 502 of FIGS. 1-3 according to some implementation. In the current example, the electrolytic pumping system 502 is shown deployed down the wellbore 504. The electrolytic pumping system 502 is coupled to the surface via the tubing 506 and the electrical cable 508. In this example, the liquid may enter the opening on the conical base of the electrolytic pumping system 502 undergo oxidation, reduction, and/or redox reactions within the chambers of the electrolytic pumping system 502 and then rise up the tubing 506 towards the surface as discussed herein and indicated by arrow 510.

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A pump comprising:

a conical base at a first end of the pump, the conical base having an opening to allow reservoir liquid exterior to the pump to enter the pump as pumping liquid;

a discharge head at a second end, the second end opposite the first end of the pump;

a cylindrical body configured between the conical base and the discharge head;

an interior body within the cylindrical body in fluid communication with the opening in the conical base and with the discharge head, the interior body to allow the pumping liquid to transition from the opening the conical base to tubing coupled to the discharge head; and a pumping chamber in fluid communication with the interior body, the pumping chamber including at least one anode to produce positive electrodes within the pumping liquid and at least one cathode to produce negative charges to the pumping liquid to cause redox reaction with respect to the pumping liquid producing gases and causing the pumping liquid to rise towards the discharge head.

2. The pump of claim 1, further comprising:

a cable connector enclosure in electrical communication with a power source and the at least one anode and the at least one cathode within the pumping chamber.

3. The pump of claim 1, further comprising at least one check valve within the interior body, the at least one check valve positioned within the interior body between the pumping chamber and the discharge head.

4. The pump of claim 1, further comprising:

a second pumping chamber in fluid communication with the interior body, the second pumping chamber including at least one second anode and at least one second cathode.

5. A pump configured to be deployed at a bottom of a wellbore, the pump comprising:

an opening at a first end, the opening to be in fluid communication with reservoir liquid during operations;

an interior body in fluid communication with the opening; and a pumping chamber in fluid communication with the interior body, the pumping chamber including at least one anode to cause a reaction to electrically charge a portion of the reservoir liquid to form gases and a positive pressure with respect to the reservoir liquid.

6. The pump of claim 1, further comprising a conical base at the first end of the pump.

7. The pump of claim 1, further comprising a discharge head at a second end, the second end opposite the first end of the pump.

8. The pump of claim 1, wherein the pump has a substantially cylindrical body.

9. The pump of claim 8, wherein the substantially cylindrical body has a circumference between approximately 2 and ⅜ inches and approximately 14 inches.

10. The pump of claim 1, wherein the pumping chamber including at least one cathode.

11. The pump of claim 1, further comprising a second pumping chamber in fluid communication with the interior body, the second pumping chamber including at least one second anode.

12. The pump of claim 1, further comprising a second pumping chamber in fluid communication with the interior body, the second pumping chamber including at least one cathode.

13. A pump configured to be deployed at a bottom of a wellbore, the pump comprising:

an opening at a first end, the opening to be in fluid communication with reservoir liquid during operations;

an interior body in fluid communication with the opening; and a pumping chamber in fluid communication with the interior body, the pumping chamber including at least one cathode to cause a reaction to introduce a positive pressure in a portion of the reservoir liquid to cause the portion of the reservoir liquid to rise without use of a motor to provide mechanical based force or suction.

14. The pump of claim 13, further comprising:

a conical base at the first end of the pump, the conical base having the opening;

a discharge head at a second end of the pump, the second end opposite the first end of the pump; and a body configured between the conical base and the discharge head, the body surrounding the interior body.

15. The pump of claim 13, further comprising a second pumping chamber in fluid communication with the interior body, the second pumping chamber including at least one anode.

16. The pump of claim 13, further comprising a second pumping chamber in fluid communication with the interior body, the second pumping chamber including at least one second cathode.

17. The pump of claim 13, wherein the pumping chamber in fluid communication with the interior body, the pumping chamber including at least one anode.

18. The pump of claim 1, wherein the oxidation reaction producing the oxygen gases causes the pumping liquid to rise without introducing mechanical based suction.

19. The pump of claim 1, further comprising at least one element to raise the temperature of the pumping liquid.

20. The pump of claim 1, further comprising an electrical source coupled to the at least one anode and the at least one cathode to provide power for generating the positive electrodes and negative charges within the pumping chamber.

* * * * *